US012359525B2

(12) United States Patent
Alharbi et al.

(10) Patent No.: US 12,359,525 B2
(45) Date of Patent: Jul. 15, 2025

(54) HAMMER SHEAR RAM

(71) Applicant: Saudi Arabian Oil Company, Dhahran (SA)

(72) Inventors: Atallah N. Alharbi, Dammam (SA); Salman Al-Anazi, Al Kohbar (SA)

(73) Assignee: Saudi Arabian Oil Company, Dhahran (SA)

( * ) Notice: Subject to any disclaimer, the term of this patent is extended or adjusted under 35 U.S.C. 154(b) by 72 days.

(21) Appl. No.: 18/320,027

(22) Filed: May 18, 2023

(65) Prior Publication Data

US 2024/0384619 A1 Nov. 21, 2024

(51) Int. Cl.
*E21B 33/06* (2006.01)

(52) U.S. Cl.
CPC ..... *E21B 33/063* (2013.01); *E21B 33/06* (2013.01)

(58) Field of Classification Search
CPC ..... E21B 33/06; E21B 33/061; E21B 33/062; E21B 33/064; E21B 28/00; E21B 33/063
See application file for complete search history.

(56) References Cited

U.S. PATENT DOCUMENTS 6,969,042 B2 * 11/2005 Gaydos ..... E21B 33/063 251/1.3
7,194,938 B2 * 3/2007 Hollar ..... B25B 21/005 81/463
7,832,480 B1 * 11/2010 Fanguy ..... E21B 33/063 166/85.1
8,387,706 B2 3/2013 Baugh
8,448,915 B2 5/2013 Baugh
10,190,382 B2 * 1/2019 Akhare ..... E21B 33/063
2009/0078466 A1 * 3/2009 Luo ..... E21B 21/12 175/171

FOREIGN PATENT DOCUMENTS

| | | |
|---|---|---|
| AU | 2012268781 | 7/2012 |
| CN | 208982002 | 6/2019 |
| RU | 202389 | 2/2021 |

* cited by examiner

*Primary Examiner* — Craig M Schneider
*Assistant Examiner* — Andrew J Rost
(74) *Attorney, Agent, or Firm* — Fish & Richardson P.C.

(57) ABSTRACT

A wellbore assembly includes a housing and a ram assembly that includes a linear actuator, a reciprocating actuator, and a ram block. The housing is coupled to a blowout preventer coupled to a wellbore. The housing receives a wellbore pipe. The ram assembly is disposed at least partially within the housing. The linear actuator is coupled to the housing. The reciprocating actuator is coupled to an end of the linear actuator. The ram block is coupled to the reciprocating actuator. The linear actuator extends to bias the ram block against the wellbore pipe, and the reciprocating actuator moves the ram block in a reciprocating or vibratory motion against the wellbore pipe.

24 Claims, 4 Drawing Sheets

HAMMER SHEAR RAM

TECHNICAL FIELD

This disclosure relates to blowout preventer equipment.

BACKGROUND

Blowout preventers are large valve assemblies that reside at the top of a well. Blowout preventers control the flow of formation fluids to the surface in case of an emergency. Blowout prevents include one or more sets of rams such as blind rams and shear rams. Blind rams close any portion that lacks a wellbore string and shear rams cut the wellbore string and seal the wellbore. Blowout preventers can prevent on-site blowouts and other uncontrolled releases of fluids from the wellbore.

SUMMARY

Implementations of the present disclosure include a wellbore assembly, that includes a housing and a ram assembly that includes a linear actuator, a reciprocating actuator, and a ram block. The housing is coupled to a blowout preventer coupled to a wellbore. The housing receives a wellbore pipe. The ram assembly is disposed at least partially within the housing. The linear actuator is coupled to the housing. The reciprocating actuator is coupled to an end of the linear actuator. The ram block is coupled to the reciprocating actuator. The linear actuator extends to bias the ram block against the wellbore pipe, and the reciprocating actuator moves the ram block in a reciprocating or vibratory motion against the wellbore pipe.

In some implementations, the reciprocating actuator has a cylinder rod and a reciprocating hammer. The cylinder rod has a first end coupled to and movable by the linear actuator. The cylinder rod has a second, opposite end coupled to the ram block. The cylinder rod has an outwardly projecting shoulder between the first end and the second end. The reciprocating hammer resides between the outwardly projecting shoulder and the linear actuator. In some implementations, the reciprocating hammer strikes reciprocating or vibratory blows on the outwardly projecting shoulder, moving the ram block in the reciprocating or vibratory motion against the wellbore pipe.

In some implementations, the reciprocating hammer has a ring-shaped piston residing around the cylinder rod and fluidly coupled to a hydraulic circuit that moves the ring-shaped piston in the reciprocating, vibratory motion.

In some implementations, the reciprocating actuator includes a cylinder, a reciprocating piston, and a cylinder rod. The cylinder is coupled to and movable by the linear actuator. The reciprocating piston resides within the cylinder. The cylinder rod is disposed partially within the cylinder and movable by the reciprocating piston. The ram assembly includes a ram shaft including a first end fixed to the cylinder rod and a second, opposite end fixed to the ram block. The reciprocating piston strikes reciprocating blows on the cylinder rod, moving the ram block in the vibratory motion against the wellbore pipe.

In some implementations, the linear actuator includes a linear actuator cylinder coupled to the housing and a linear actuator rod disposed at least partially within the linear actuator cylinder. In some implementations, the linear actuator rod is fixed to the reciprocating actuator and extends to move the reciprocating actuator and the ram block toward the wellbore pipe.

In some implementations, the wellbore assembly includes a second ram assembly disposed at least partially within the housing and facing the ram assembly. The second ram assembly includes a second linear actuator, a second reciprocating actuator, and a second reciprocating actuator. The second linear actuator is coupled to the housing. The second reciprocating actuator is coupled to an end of the second linear actuator. The second reciprocating actuator is coupled to the second reciprocating actuator. In some implementations, the second linear actuator extends to bias the second ram block against a surface of the wellbore pipe opposite a surface engaged by the ram block. The second reciprocating actuator moves the second ram block in a reciprocating, vibratory motion against the wellbore pipe. In some implementations, the ram block includes a shear ram block and the second ram block includes a second shear ram block that cuts, with the ram block, the wellbore pipe.

In some implementations, the linear actuator includes a hydraulic actuator and the reciprocating actuator includes one of an electrical reciprocating actuator, a hydraulic reciprocating actuator, or a pneumatic reciprocating actuator.

In some implementations, the reciprocating actuator is fluidly coupled to a hydraulic circuit including a hydraulic fluid that moves a piston of the reciprocating actuator in a reciprocating motion.

Implementations of the present disclosure include a method that includes actuating a linear actuator of a ram to move a ram block toward a wellbore pipe. The ram includes a reciprocating actuator attached to and disposed between the linear actuator and the ram block. The ram includes a ram body coupled to a blowout preventer and configured to receive the wellbore pipe. The method also includes actuating the reciprocating actuator to move the ram block in a reciprocating or vibratory motion against the wellbore pipe.

In some implementations, actuating the reciprocating actuator includes actuating the reciprocating actuator such that the reciprocating actuator reciprocates the ram block as the linear actuator biases the ram block toward the wellbore pipe. In some implementations, the reciprocating actuator reciprocates the ram block such that the ram block impacts the wellbore tube with enough force and vibration to cause the wellbore pipe to break.

In some implementations, actuating the linear actuator includes activating a first hydraulic circuit fluidly coupled to the linear actuator and includes a hydraulic fluid that moves, upon activation of the hydraulic circuit, a cylinder rod of the linear actuator. In some implementations, actuating the reciprocating actuator includes activating a second hydraulic circuit fluidly coupled to the reciprocating actuator. In some implementations, the second hydraulic circuit includes a hydraulic fluid that alternately moves, upon activation of the second hydraulic circuit, a reciprocating piston of the reciprocating actuator. The reciprocating piston strikes reciprocating blows on the rod coupled to the ram block, moving the ram block in the vibratory motion against the wellbore pipe In some implementations, the method further includes, after actuating the reciprocating actuator, actuating the linear actuator, retracting the linear actuator.

Particular implementations of the subject matter described in this specification can be implemented so as to realize one or more of the following advantages. For example, the shear rams of the present disclosure can use impact energy and vibration to more reliably and effectively cut a wellbore pipe compared to traditional shear rams. Also, the shear rams of the present disclosure can be stronger than traditional shear rams and can prevent the shear rams from becoming stuck, which is particularly important in emergency situations.

DETAILED DESCRIPTION OF THE DISCLOSURE

The present disclosure describes a hydraulic hammer shear ram for a blowout preventer (BOP). The BOP shear ram has two spaced-apart rams facing each other. When retracted, the rams are spaced from each other and do not block the wellbore. When extended, the rams cut the wellbore pipe (for example, drill string or production string) disposed within the wellbore.

Each ram has a reciprocating actuator that causes the ram blocks to reciprocate or vibrate to more effectively cut the wellbore pipe. Additionally, the reciprocating actuator can help get the rams unstuck and fully extend to their final position when debris or other obstructions are an issue.

Figure 1:
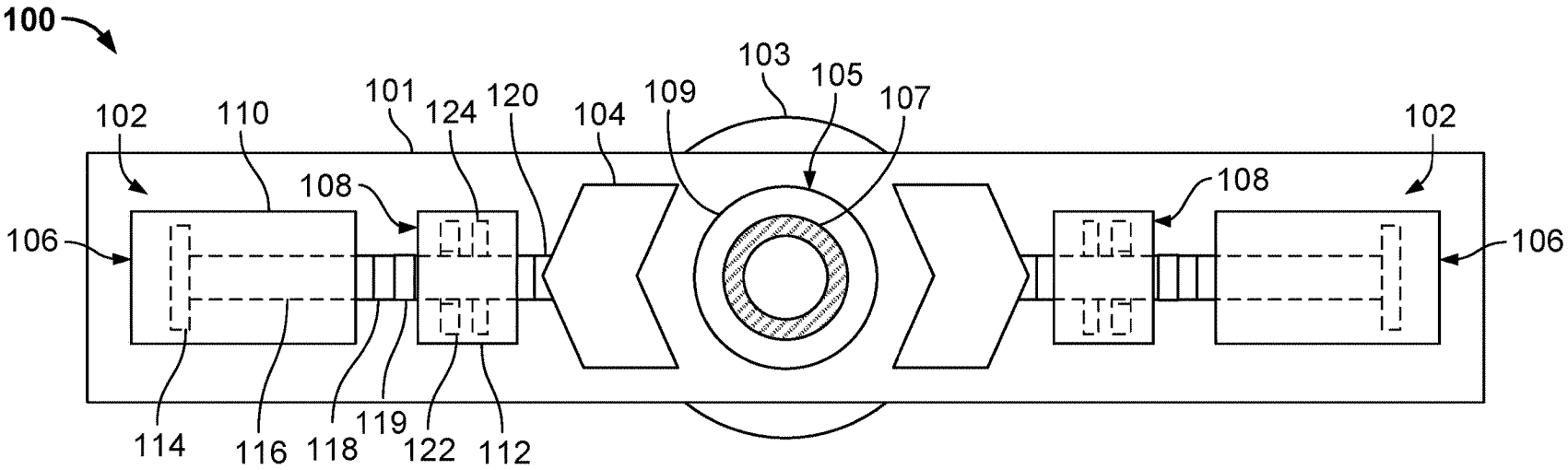
FIG. 1 is a top schematic view, partially cross-sectional, of a shear ram assembly according to one embodiment of the present disclosure, in a retracted position.

FIG. 1 shows a shear ram assembly 100 that is part of a blowout preventer (BOP) 103. The BOP 103 is at the surface of a wellbore 105. For example, the BOP 103 can reside above or below a wellhead (not shown) of the wellbore 105. The wellbore 105 includes a wellbore string or pipe 107 such as a drill string or a production string that extends into the wellbore 105.

The shear ram assembly 100 is disposed at least partially within a housing 101 attached to the BOP 103. The housing 101 has a hole 109 that receives the wellbore string 107. The wellbore string 107 extends through the shear ram assembly 100 and into the wellbore to inject fluid (for example, drilling fluid during drilling or stimulation fluid during well stimulation) or direct fluid (for example, production fluid during hydrocarbon production) to the surface of the wellbore 105.

The shear ram assembly 100 has two rams 102. Each shear ram 102 includes a linear actuator 106, a reciprocating (or vibrating) actuator 108, and a ram block 104. The linear actuator 106 includes a cylinder 110 that resides inside or outside of the housing 101. The cylinder 110 is fixed to the housing 101 so that as the linear actuator 106 extends, its cylinder 110 remains in place with respect to the wellbore 105.

The linear actuator 106 can be a hydraulic actuator, pneumatic actuator, or electric actuator. Similarly, the reciprocating actuator 108 can be a hydraulic actuator, pneumatic actuator, or electric actuator. For example, the linear actuator 106 can be a hydraulic actuator and the reciprocating actuator 108 can be a hydraulic or electric actuator. The reciprocating actuator 108 acts as a hammer (for example, a jack hammer or rock breaker) in that it vibrates or repeatedly strikes the pipe 107 to increase the cutting speed and effectiveness of the shear rams 102.

The linear actuator 106 can be a hydraulic actuator that includes a piston 114 and a cylinder rod 116 attached to the piston 114. The cylinder rod 116 extends out of the cylinder 110 as the piston 114 is pushed under hydraulic pressure. The rod 116 is fixed to the reciprocating actuator 108 to push the reciprocating actuator and the ram block 104 toward the pipe 107 as the cylinder rod 116 extends. As the rod 116 pushes the ram block 104 against the pipe 107, the reciprocating actuator 108 moves the ram block 104 in a reciprocating, vibratory motion against the pipe 107.

In the embodiment shown in FIG. 1, the reciprocating actuator 108 includes a cylinder 112 and a rod 118 that extends through the cylinder 112. The rod 118 is fixed to the cylinder rod 116 at one end and fixed to the ram block 104 at its opposite end. The rod 118 has an outwardly-projecting shoulder 124 (for example, a solid plate) and an impact piston 122 or reciprocating/vibrating hammer mass that strikes the shoulder 124. The impact piston 122 can be a ring-shaped piston residing around the cylinder rod 118 and, as further described in detail below with respect to FIG. 3, can be fluidly coupled to a hydraulic circuit that moves the ring-shaped piston in a reciprocating motion.

In some embodiments, the assembly 100 includes a shock absorber 119 or mechanical damper between the reciprocating actuator 108 and the linear actuator 106. The shock absorber 119 reduces or eliminates the vibration from the reciprocating actuator 108 to the linear actuator 106, ensuring that the shocks (or vibration) from the reciprocating actuator 108 only (or mostly) goes to shear ram. The shock absorber 119 can be, for example, a hydraulic shock absorber, a spring, a rubber element (e.g., a rubber block or a rubber mount), or a similar component (or a combination of these) that absorbs the vibration from the reciprocating actuator 108.

The rod 116 is moved by the linear actuator 106, while the cylinder 112 remains in place or moves momentarily with the rod 118 until the impact piston 122 is activated, in which case the cylinder 112 remains in place with respect to the wellbore 105. The rod 118 can be attached to a ram rod 120 that is attached to the ram block 104 to move the ram block 104.

Figure 2:
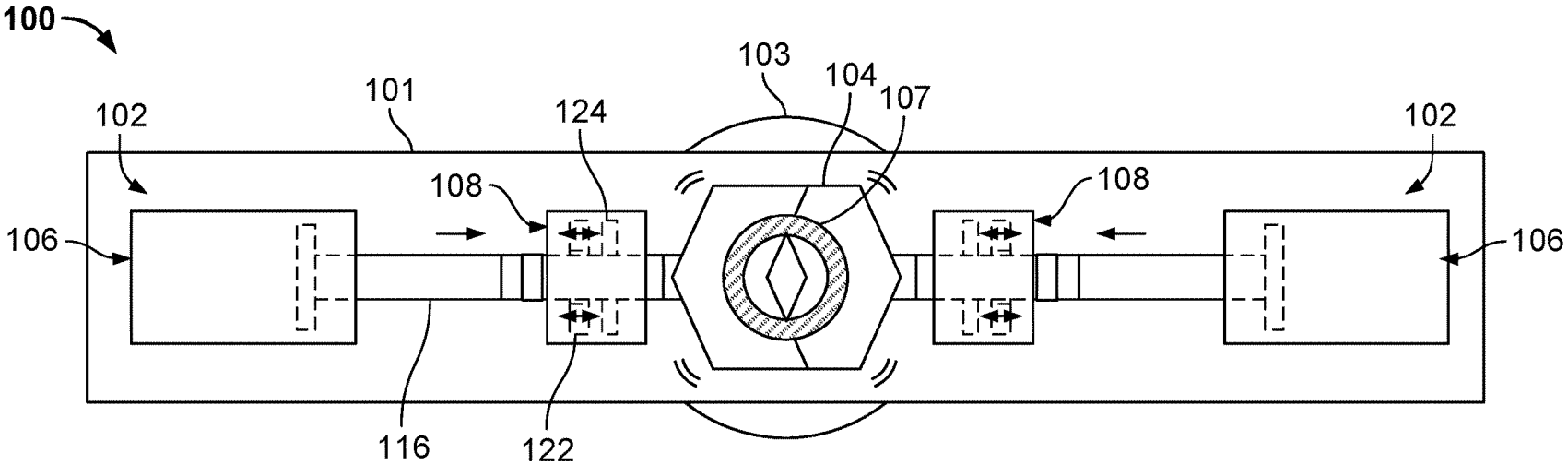
FIG. 2 is a top schematic view, partially cross-sectional, of the shear ram assembly in FIG. 1, in an extended position.

FIG. 2 shows both shear rams 102 activated to cut or shear off the pipe 107. The shear reams 102 are offset with respect to each other, with one at a higher elevation than the other to cut the pipe 107 like scissors. When activated, each of the linear actuators 106 is extended by pushing out their cylinder rods 116. The cylinder rods 116 push the reciprocating actuators 108, which in turn push the ram blocks 104 against the pipe.

The linear actuator 106 can be activated before, during, or after the reciprocating actuator 108 is activated. Once the reciprocating actuator 108 is activated, the impact piston 122 moves side to side repeatedly to strike reciprocating blows on the shoulder 124, moving the ram block 104 in a reciprocating motion against the wellbore pipe 107. The impact piston 122 causes the ram blocks 104 to reciprocate or vibrate from side to side to cut the pipe 107. The reciprocating motion can also prevent the rams 102 from becoming stuck, which increases the reliability of the rams 102.

Once the cylinder rods 116 are fully extended, the ram blocks 104 have fully cut the pipe 107. In some cases, the ram blocks 104 can also seal the wellbore by cutting the pipe 107 and blocking the wellbore. Although the ram block 104 is shown as a shear ram block with sharp edges, the ram block 104 can be a different type of ram block such as a blind ram block.

Figure 3:
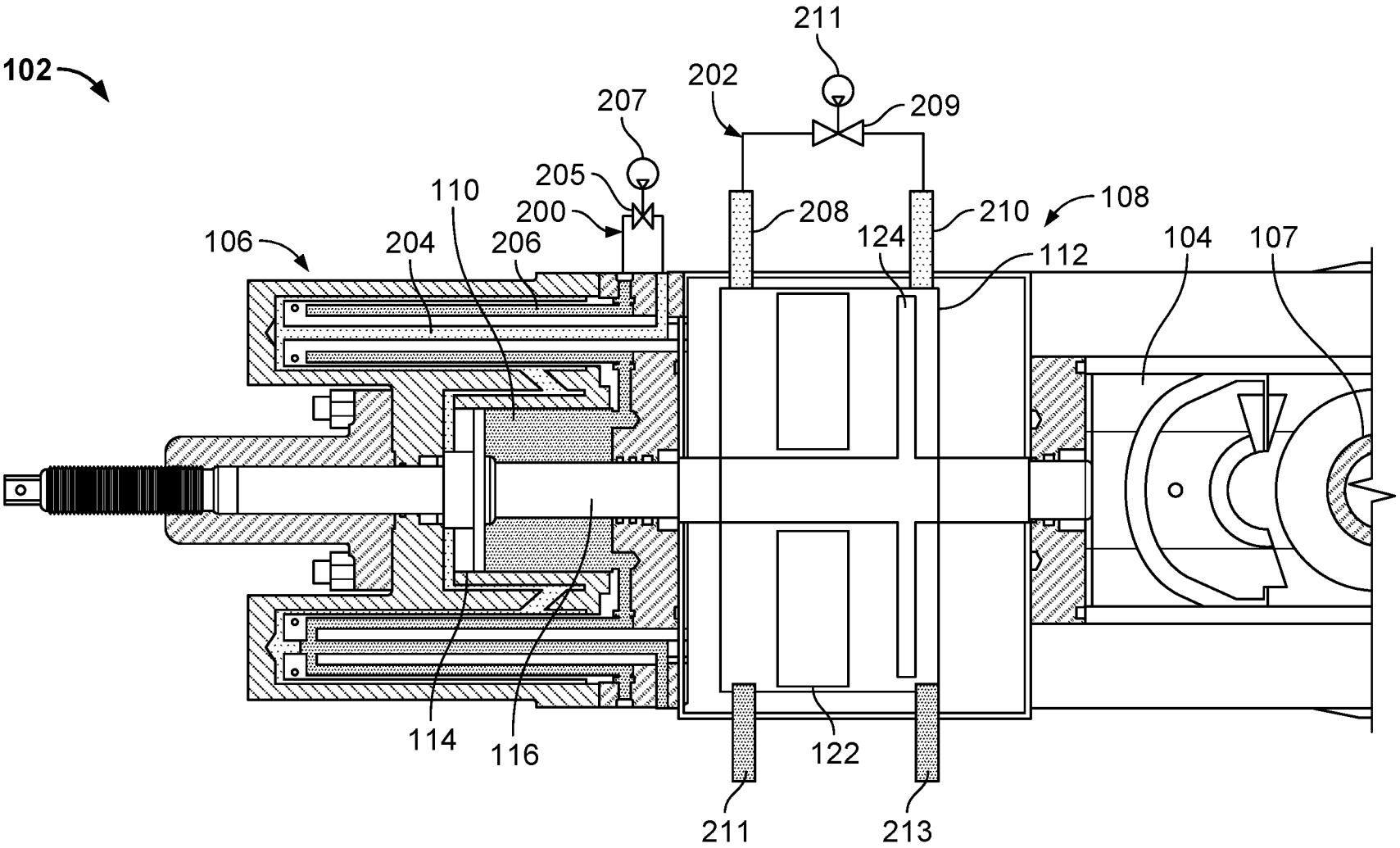
FIG. 3 is a top schematic view, partially cross-sectional, of a portion of the shear ram assembly in FIG. 1.

FIG. 3 shows example hydraulic circuits 200, 202 of the linear actuator 106 and the reciprocating actuator 108, respectively. The hydraulic circuit 200 of the linear actuator 106 includes a first hydraulic line or conduit 204 and a second hydraulic line or conduit 206. The hydraulic lines can be connected to a valve 205 that controls the direction of the hydraulic fluid received from a pump 207. For example, to extend the rod 116, the valve 205 closes the second hydraulic conduit 206 and opens the first hydraulic conduit 204 to expand the volume to the left of the piston 114, pushing the piston 114 and rod 116 to the right, toward the pipe 107. To retract the rod 116, the valve 205 closes the first hydraulic conduit 204 and opens the second hydraulic conduit 206 to expand the volume to the right of the piston 114, pushing the piston 114 and rod 116 to the left, away from the pipe 107.

The hydraulic circuit 202 of the reciprocating actuator 108 includes a first hydraulic line or conduit 208 and a second hydraulic line or conduit 210. The hydraulic lines can be connected to a valve 209 that controls the direction of the hydraulic fluid received from a pump 211. The pump 211 flows fluid at a high enough flow rate to move the impact piston 122 rapidly. Also, the valve 209 can be a control valve that moves in a rapid, reciprocating motion to change the flow of hydraulic fluid between the first line 208 and second line 210 rapidly. For example, the valve 209 can move from side to side multiple times in one second, or one time every one to five seconds. In some aspects, each time the valve changes from one side to the other, the impact piston 122 is moved to either impact the shoulder 124 or move away from the shoulder 124.

For example, when the valve 209 moves to one side, the valve 209 closes the second hydraulic line 210 and opens the first hydraulic line 208 to flow a fluid that moves the impact piston 122 to the right, impacting the shoulder 124. When the valve 209 moves to the other side, the valve 209 closes the first hydraulic line 208 and opens the second hydraulic line 210 to flow a fluid that moves the impact piston 122 to the left, away from the shoulder 124. The rapid change of flow between the first line 218 and the second line 210 causes the impact piston 122 to reciprocate, striking the shoulder 124 repeatedly.

Figure 4:
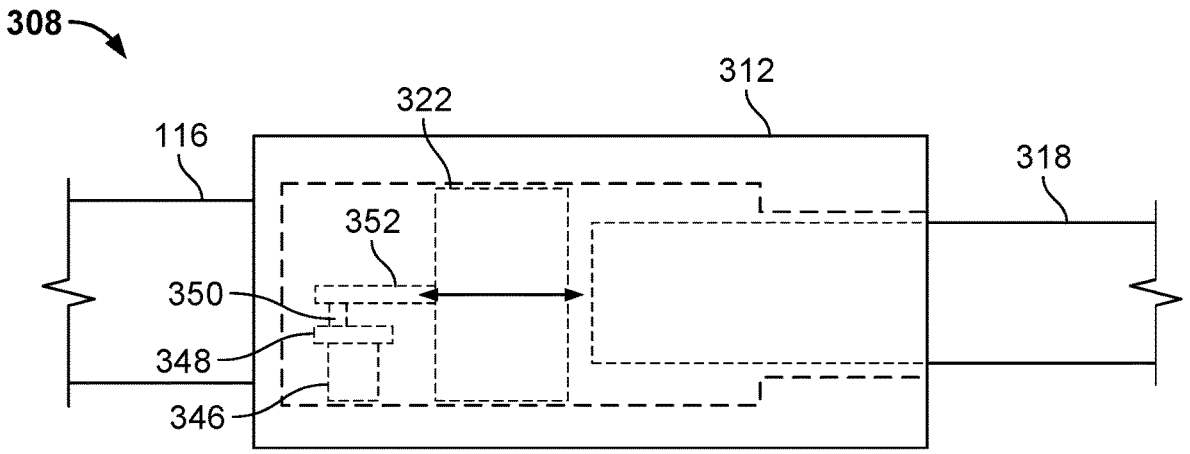
FIG. 4 is a top schematic view, of a reciprocating actuator according to one embodiment of the present disclosure.

FIG. 4 shows a reciprocating actuator 308 according to a different embodiment. The reciprocating actuator 308 can be arranged similar to a traditional rock breaker, in that its cylinder 312 houses an impact piston 322 and a portion of a rod (similar to a breaker chisel) that is struck by the impact piston 322 at one end and is attached to the ram block at its opposite end. In such an embodiment, the cylinder 312 is fixed to the rod 116 of the linear actuator 106 and is moved by the linear actuator. As the impact piston 322 reciprocates and strikes the end of the rod 318, the rod 310 transmits such energy to the ram block.

As shown in FIG. 4, the impact piston 322 can be moved by hydraulic or pneumatic fluid (similar to the embodiment shown in FIG. 3) or by an electric motor 346. For example, the motor 346 can rotate a flywheel 348 that rotates a crank 350 connected to a rod or arm 352 that moves the piston 322 left and right as the flywheel 348 rotates.

Figure 5:
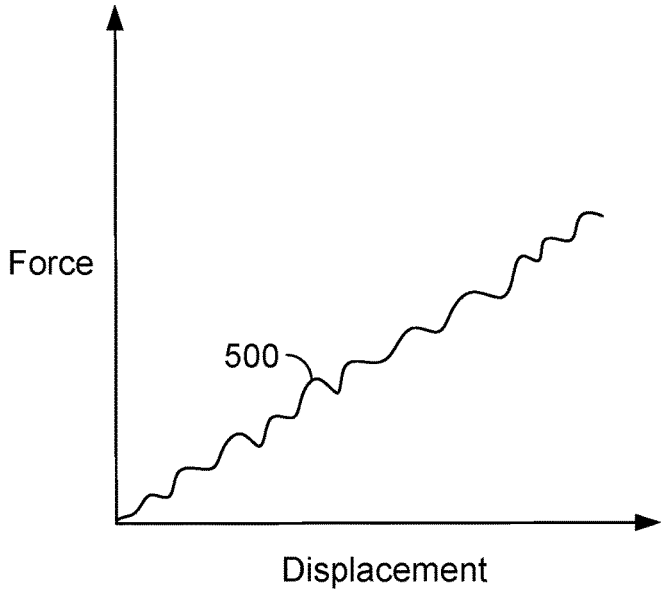
FIG. 5 is a displacement versus force curve of the shear ram assembly.

FIG. 5 is a displacement versus force curve 500 of the ram 102 when actuated. As shown, in some embodiments, the "reciprocating" motion (or vibratory motion) is a small side-to-side movement or vibration instead of large reciprocation. The small vibration do not affect (or substantially affect) the general direction of the force. For example, as shown in FIG. 5, the general force of the shear block is increased as the linear actuator is displaced (e.g., extended), while at a smaller level the shear block is vibrating or reciprocating. Frequency and amplitude of these vibrations can be optimized using iterations and simulation.

Figure 6:
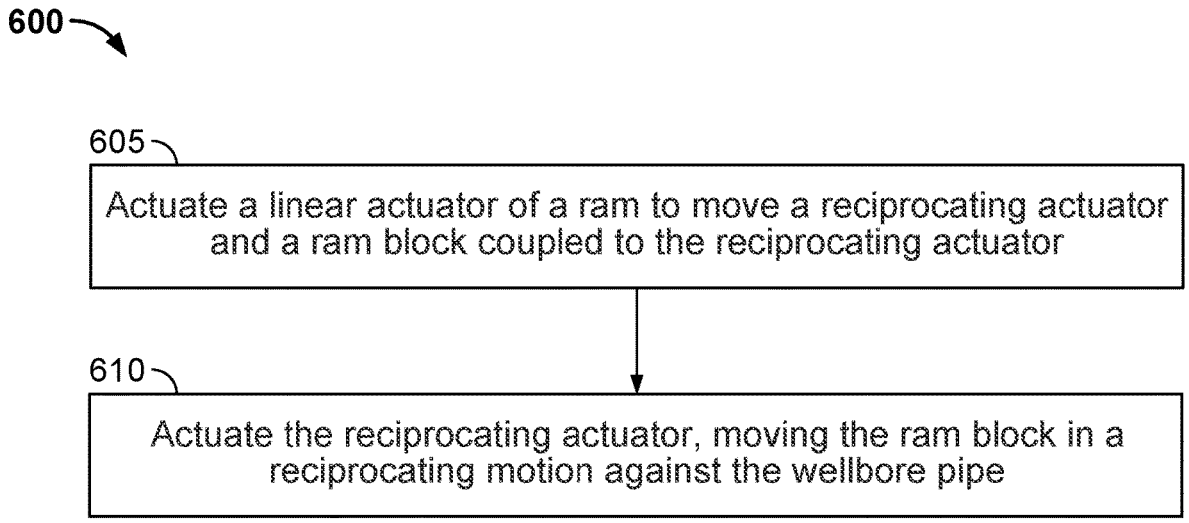
FIG. 6 is a flow chart of a method of cutting a wellbore string.

FIG. 6 shows a flow chart of a method (600) of cutting a wellbore pipe. The method includes actuating a linear actuator of a ram to move a ram block toward a wellbore pipe. The ram has a reciprocating actuator attached to and disposed between the linear actuator and the ram block. The ram has a ram body coupled to a blowout preventer and configured to receive the wellbore pipe (605). The method also includes actuating the reciprocating actuator to move the ram block in a reciprocating motion against the wellbore pipe (610).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A wellbore assembly, comprising:

a housing configured to be coupled to a blowout preventer configured to be coupled to a wellbore, the housing configured to receive a wellbore pipe; and a ram assembly configured to be disposed at least partially within the housing, the ram assembly comprising:

a linear actuator configured to be coupled to the housing;

a reciprocating actuator configured to be coupled to an end of the linear actuator; and a ram block configured to be coupled to the reciprocating actuator;

wherein the linear actuator is configured to extend to bias the ram block against the wellbore pipe, and the reciprocating actuator comprises a cylinder rod and a reciprocating hammer or piston configured to strike the cylinder rod to move the ram block in a reciprocating or vibratory motion against the wellbore pipe.

2. The wellbore assembly of claim 1, wherein the linear actuator comprises a linear actuator cylinder coupled to the housing and a linear actuator rod disposed at least partially within the linear actuator cylinder.

3. The wellbore assembly of claim 2, wherein the linear actuator rod is fixed to the reciprocating actuator and configured to extend to move the reciprocating actuator and the ram block toward the wellbore pipe.

4. The wellbore assembly of claim 1, wherein the wellbore assembly comprises a second ram assembly configured to be disposed at least partially within the housing and facing the ram assembly, the second ram assembly comprising:

a second linear actuator configured to be coupled to the housing;

a second reciprocating actuator configured to be coupled to an end of the second linear actuator; and a second ram block configured to be coupled to the second reciprocating actuator.

5. The wellbore assembly of claim 4, wherein the second linear actuator is configured to extend to bias the second ram block against a surface of the wellbore pipe opposite a surface engaged by the ram block, and the second reciprocating actuator is configured to move the second ram block in a reciprocating, vibratory motion against the wellbore pipe.

6. The wellbore assembly of claim 4, wherein the ram block comprises a shear ram block and the second ram block comprises a second shear ram block configured to cut, with the ram block, the wellbore pipe.

7. The wellbore assembly of claim 1, wherein the linear actuator comprises a hydraulic actuator and the reciprocating actuator comprises one of an electrical reciprocating actuator, a hydraulic reciprocating actuator, or a pneumatic reciprocating actuator.

8. The wellbore assembly of claim 1, wherein the reciprocating actuator is fluidly coupled to a hydraulic circuit comprising a hydraulic fluid that moves a piston of the reciprocating actuator in a reciprocating motion.

9. The wellbore assembly of claim 1, wherein the reciprocating hammer is configured to strike reciprocating blows on an outwardly projecting shoulder of the cylinder rod, moving the ram block in the reciprocating or vibratory motion against the wellbore pipe.

10. The method of claim 9, wherein the reciprocating hammer comprises a ring-shaped piston residing around the cylinder rod and fluidly coupled to a hydraulic circuit that moves the ring-shaped piston in the reciprocating or vibratory motion to strike the outwardly projecting shoulder.

11. A wellbore assembly, comprising:

a housing configured to be coupled to a blowout preventer configured to be coupled to a wellbore, the housing configured to receive a wellbore pipe; and a ram assembly configured to be disposed at least partially within the housing, the ram assembly comprising:

a linear actuator configured to be coupled to the housing;

a reciprocating actuator configured to be coupled to an end of the linear actuator; and a ram block configured to be coupled to the reciprocating actuator;

wherein the linear actuator is configured to extend to bias the ram block against the wellbore pipe, and the reciprocating actuator is configured to move the ram block in a reciprocating or vibratory motion against the wellbore pipe;

wherein the reciprocating actuator comprises:

a cylinder rod comprising a first end configured to be coupled to and movable by the linear actuator, and a second, opposite end coupled to the ram block, the cylinder rod comprising an outwardly projecting shoulder between the first end and the second end; and a reciprocating hammer residing between the outwardly projecting shoulder and the linear actuator.

12. The wellbore assembly of claim 11, wherein the reciprocating hammer is configured to strike reciprocating blows on the outwardly projecting shoulder, moving the ram block in the reciprocating or vibratory motion against the wellbore pipe.

13. The wellbore assembly of claim 11, wherein the reciprocating hammer comprises a ring-shaped piston residing around the cylinder rod and fluidly coupled to a hydraulic circuit that moves the ring-shaped piston in the reciprocating or vibratory motion.

14. A wellbore assembly, comprising:

a housing configured to be coupled to a blowout preventer configured to be coupled to a wellbore, the housing configured to receive a wellbore pipe; and a ram assembly configured to be disposed at least partially within the housing, the ram assembly comprising:

a linear actuator configured to be coupled to the housing;

a reciprocating actuator configured to be coupled to an end of the linear actuator; and a ram block configured to be coupled to the reciprocating actuator;

wherein the linear actuator is configured to extend to bias the ram block against the wellbore pipe, and the reciprocating actuator is configured to move the ram block in a reciprocating or vibratory motion against the wellbore pipe;

wherein the reciprocating actuator comprises:

a cylinder configured to be coupled to and movable by the linear actuator;

a reciprocating piston residing within the cylinder; and a cylinder rod disposed partially within the cylinder and movable by the reciprocating piston.

15. The wellbore assembly of claim 14, wherein the ram assembly comprises a ram shaft comprising a first end fixed to the cylinder rod and a second, opposite end fixed to the ram block, and the reciprocating piston is configured to strike reciprocating blows on the cylinder rod, moving the ram block in a vibratory motion against the wellbore pipe.

16. A method, comprising:

actuating a linear actuator of a ram to move a ram block toward a wellbore pipe, the ram comprising a reciprocating actuator attached to and disposed between the linear actuator and the ram block, the reciprocating actuator comprising a cylinder rod and a reciprocating hammer or piston configured to strike the cylinder rod, the ram comprising a ram body coupled to a blowout preventer and configured to receive the wellbore pipe; and actuating the reciprocating actuator to cause the reciprocating hammer or piston to strike the cylinder rod to move the ram block in a reciprocating or vibratory motion against the wellbore pipe.

17. The method of claim 16, wherein actuating the reciprocating actuator comprises actuating the reciprocating actuator such that the reciprocating actuator reciprocates the ram block as the linear actuator biases the ram block toward the wellbore pipe.

18. The method of claim 16, wherein actuating the linear actuator comprises activating a first hydraulic circuit fluidly coupled to the linear actuator and comprising a hydraulic fluid that moves, upon activation of the hydraulic circuit, the cylinder rod of the linear actuator.

19. The method of claim 18, wherein actuating the reciprocating actuator comprises activating a second hydraulic circuit fluidly coupled to the reciprocating actuator.

20. The method of claim 16, further comprising, after actuating the reciprocating actuator, actuating the linear actuator, retracting the linear actuator.

21. A method, comprising:

actuating a linear actuator of a ram to move a ram block toward a wellbore pipe, the ram comprising a reciprocating actuator attached to and disposed between the linear actuator and the ram block, the ram comprising a ram body coupled to a blowout preventer and configured to receive the wellbore pipe; and actuating the reciprocating actuator to move the ram block in a reciprocating or vibratory motion against the wellbore pipe;

wherein actuating the reciprocating actuator comprises actuating the reciprocating actuator such that the reciprocating actuator reciprocates the ram block as the linear actuator biases the ram block toward the wellbore pipe; and wherein the reciprocating actuator reciprocates the ram block such that the ram block impacts the wellbore pipe with enough force and vibration to cause the wellbore pipe to break.

22. The method of claim 21, wherein actuating the reciprocating actuator comprises moving a reciprocating hammer of the reciprocating actuator to strike, with the reciprocating hammer, reciprocating blows on an outwardly projecting shoulder of a cylinder rod coupled with the ram block to move the ram block in the reciprocating or vibratory motion against the wellbore pipe.

23. A method, comprising:

actuating a linear actuator of a ram to move a ram block toward a wellbore pipe, the ram comprising a reciprocating actuator attached to and disposed between the linear actuator and the ram block, the ram comprising a ram body coupled to a blowout preventer and configured to receive the wellbore pipe; and actuating the reciprocating actuator to move the ram block in a reciprocating or vibratory motion against the wellbore pipe;

wherein actuating the linear actuator comprises activating a first hydraulic circuit fluidly coupled to the linear actuator and comprising a hydraulic fluid that moves, upon activation of the hydraulic circuit, a cylinder rod of the linear actuator;

wherein actuating the reciprocating actuator comprises activating a second hydraulic circuit fluidly coupled to the reciprocating actuator; and wherein the second hydraulic circuit comprises a hydraulic fluid that alternately moves, upon activation of the second hydraulic circuit, a reciprocating piston of the reciprocating actuator, the reciprocating piston configured to strike reciprocating blows on a rod coupled to the ram block, moving the ram block in a vibratory motion against the wellbore pipe.

24. The method of claim 23, wherein actuating the reciprocating actuator comprises moving a reciprocating hammer of the reciprocating actuator to strike, with the reciprocating hammer, reciprocating blows on an outwardly projecting shoulder of a cylinder rod coupled with the ram block to move the ram block in the reciprocating or vibratory motion against the wellbore pipe.

* * * * *